United States Patent [19]

Heile et al.

[11] Patent Number: 4,680,134

[45] **Date of Patent: * Jul. 14, 1987**

[54] METHOD FOR FORMING SOLID DETERGENT COMPOSITIONS

[75] Inventors: Bernard J. Heile, Apple Valley; Terry J. Klos, Minnetonka, both of Minn.

[73] Assignee: Ecolab Inc., St. Paul, Minn.

[ * ] Notice: The portion of the term of this patent subsequent to Jun. 17, 2003 has been disclaimed.

[21] Appl. No.: 840,455

[22] Filed: Mar. 17, 1986

Related U.S. Application Data

[63] Continuation of Ser. No. 663,473, Oct. 18, 1984, Pat. No. 4,595,520.

[51] Int. Cl.[4] ..... C11D 7/56

[52] U.S. Cl. ..... 252/160; 252/99; 252/135; 252/140; 252/174.25; 252/186.26; 252/DIG. 14

[58] Field of Search ..... 252/89.1, 99, 135, 140, 252/160, 173, 174.23, 174.25, 174.26, DIG. 14

[56] References Cited

U.S. PATENT DOCUMENTS

| | | | |
|---|---|---|---|
| 2,382,165 | 8/1945 | MacMahon | 252/135 |
| 2,920,417 | 1/1960 | Wertheimer | 45/28 |
| 2,987,483 | 6/1961 | Brooker | 252/138 |
| 4,512,908 | 4/1985 | Heile | 252/160 |

OTHER PUBLICATIONS

P. J. Fernholz, et al., U.S. Ser. No. 509,916 filed Jul. 1, 1983.

B. J. Heile, U.S. Ser. No. 510,947, filed Jul. 5, 1983.

R. Perkins, et al.-Laponite RD and Laponite RDS(L.47) Laponite Industries, Ltd.

P. J. Fernholz, et al. U.S. Ser. No. 234,940 filed Feb. 25, 1980.

Decision of the Board of Patent Appeals and Interferences, Ex Parte Peter J. Fernholz, et al. Appeal No. 561-03 (Jun. 19, 1985).

*Primary Examiner*—Paul Lieberman
*Assistant Examiner*—John F. McNally
*Attorney, Agent, or Firm*—Merchant, Gould, Smith, Edell, Welter & Schmidt

[57] ABSTRACT

Methods are disclosed for preparing solid alkaline detergent compositions from aqueous emulsions comprising water, a source of alkalinity, a condensed phosphate hardness sequestering agent and a solidifying agent such as anhydrous sodium carbonate, comprising heating said emulsion to hydrate and melt the solidifying agent and then cooling the mixture.

10 Claims, No Drawings

METHOD FOR FORMING SOLID DETERGENT COMPOSITIONS

This is a continuation of application Ser. No. 663,473, filed Oct. 18, 1984, now U.S. Pat. No. 4,595,520.

FIELD OF THE INVENTION

This invention relates to methods for forming alkaline detergent compositions. The resulting solid detergent compositions can take the form of powders, flakes, granules, tablets or larger cast objects, and can be employed as highly effective warewashing detergents, laundry detergents and general surface cleansers.

BACKGROUND OF THE INVENTION

Solid alkaline detergent compositions are widely used for household and industrial dishwashing, laundering clothing and general surface cleansing. The greater amount of such cleaning compositions consumed consists of solid powders, granules, or tablets. These detergent compositions typically incorporate a condensed phosphate hardness sequestering agent and a source of alkalinity such as an alkali metal hydroxide, carbonate, bicarbonate, silicate or mixtures thereof as their primary cleaning components. The hardness sequestering agent acts to condition the wash water by chelating or otherwise complexing the metal cations responsible for the precipitation of alkali metal builder salts and detergents. The alkaline components impart detergency to the compositions by breaking down acidic and proteinacious soils. For heavy duty industrial and institutional washing, highly alkaline chemicals such as the alkali metal hydroxides are commonly incorporated into solid detergent compositions.

In order to be effective for these applications it is necessary that the components of the solid detergent be uniformly distributed throughout the composition and that they dissolve readily in the aqueous washing medium which is employed. Soluble, solid granules incorporating uniformly-dispersed components have been formed by spray-drying aqueous slurries of the detergent components. This method requires expensive equipment such as spray drying towers and consumes large amounts of energy in the drying process. Water-sodium hydroxide slurries can be hardened by externally heating the slurries above the melting point of the sodium hydroxide monohydrate. Besides being energetically disadvantageous, these methods commonly employ temperatures at which sodium tripolyphosphate can wholly or partially revert to the pyrophosphate, orthophosphate or mixtures thereof which are much less effective in sequestering water hardness factors. Attempts to form effective solid detergent compositions by simply blending the components in particulate form often fail to achieve adequate homogenization of the components. Furthermore, solubilization difficulties are often encountered when anhydrous builder salts are combined in this manner. The high temperatures used in the spray-drying or aqueous dispersion processes can degrade other detergent components. Many applications require a source of active halogen in the solid detergent compositions to destain or bleach. The high temperatures necessary to dry and disperse the various components often lead to the total destruction of organic halogen-containing components.

A substantial need exists for methods to prepare homogeneous solid alkaline detergent compositions which rapidly dissolve in aqueous media. A need also exists for methods to prepare water-conditioning and/or active-halogenated solid detergent compositions which avoid phosphate reversion and loss of active halogen.

BRIEF DESCRIPTION OF THE INVENTION

The present invention is directed to a method of forming a solid alkaline detergent comprising components such as a condensed phosphate hardness sequestering agent and an alkaline builder salt. Alkaline detergents can also be formulated to contain a source of active halogen, organic surfactants, softeners, dispersing agents and the like. We have discovered that aqueous emulsions of detergent components can be solidified by incorporating an effective amount of one or more solidifying agents therein. The solidifying agent can hydrate to bind free water present in the emulsion to the extent that the liquid emulsion is hardened or solidified to a homogeneous solid. Preferably, the emulsion is heated to a temperature effective to form a molten, hydrated solidifying agent. The emulsion is then cooled below the melting point of the hydrated agent to effect solidification.

Preferred solidifying agents have high hydration capacities and can be melted and hydrated at temperatures below those at which phosphate reversion occurs. Anhydrous sodium carbonate and/or sodium sulfate can be employed to effectively solidify alkaline detergent emulsions. The sodium carbonate and/or sodium sulfate can be added to the emulsion during its formation at a temperature in excess of the melting point of their decahydrates. Upon cooling, the carbonate and sulfate hydrates solidify and a firm, uniform solid detergent component results. The solid detergent can be granulated or formed into tablets by filling molds with the hardening liquid. Since the temperatures required to maintain sodium carbonate decahydrate and sodium sulfate decahydrate in the liquid state are less than that at which significant phosphate reversion occurs, the finished detergent products can maintain a high level of water conditioning power. The temperatures employed in the present process are also below the decomposition points of many commonly employed active halogen sources such as halogenated diisocyanurate and alkali metal hypochlorites. Therefore, finished chlorine containing products can retain substantial available chlorine upon extended storage. The present process has been found generally useful to convert an emulsion into a solid detergent product which can be employed as a warewashing detergent, laundry detergent, a general surface cleanser and the like.

DETAILED DESCRIPTION OF THE INVENTION

The method of the present invention is particularly effective to form solid cleaners from emulsions containing a sodium condensed phosphate hardness sequestering agent and an inorganic source of alkalinity, such as an alkaline metal hydroxide. Such detergent emulsions may also incorporate a source of active halogen which will impart bleaching and disinfectant properties to the final composition. In preparing such mixtures, it has been found useful to employ clay suspending agents such as the hectorite clays in order to evenly disperse the solid components and to prevent their settling or precipitation when the mixture is cooled. Such clays have also been found to inhibit the decomposition of the active halogen source during formation of the emulsion.

Methods to prepare stable emulsions comprising these components are disclosed in copending application U.S. Ser. No. 510,947 filed July 5, 1983, the disclosure of which is incorporated by reference herein.

These emulsions are solidified by the incorporation therein of an effective amount of a solidifying agent, which preferably comprises one or more anhydrous salts, which are selected to hydrate and melt at a temperature below that at which significant phosphate reversion occurs. Such temperatures typically fall within the range of about 33°-65° C., preferably salts which melt at about 35°-50° C. will be used. The dispersed, hydrated salt solidifies when the emulsion is cooled and can bind sufficient free water to afford a stable, homogeneous solid at ambient temperatures, e.g., at about 15°-25° C. Preferably an amount of anhydrous sodium carbonate, anhydrous sodium sulfate or mixtures thereof effective to solidify the emulsions when they are cooled to ambient temperatures will be employed. The emulsion may be formed into tablets or cakes by allowing it to solidify in appropriately sized molds or may be granulated, flaked, or powdered.

The anhydrous sodium carbonate or sodium sulfate is added to the stirred liquid phase at a point during its processing where it has attained a temperature in excess of that required to hydrate and melt the hydrated salts, but at a temperature below that at which significant phosphate reversion occurs. Anhydrous sodium carbonate and anhydrous sodium sulfate have been found to be ideal solidifying agents for use in these systems since their decahydrates melt at 34.0° C. and 32.3° C. respectively. At these temperatures effective amounts of solidification agents can be introduced into the emulsions and homogenized without the occurrence of significant phosphate reversion or decomposition of the active halogen source. Furthermore, the hydration and homogenization of the anhydrous salts can often be accomplished without the application of external heat but rather by use of the internal heat generated by the dissolution of the alkaline metal hydroxide. Preferably this exotherm will be controlled so as to maintain the liquid phase at a temperature slightly above the melting point of the carbonate and sulfate decahydrates. In this manner the internal temperature of the liquid phase will be maintained at within the range of about 35° to 50° C., preferably within the range of about 40° to 45° C., until the addition of all the components is completed.

The amount of solidifying agent required to solidify a liquid detergent emulsion will depend on the percentage of water present in the emulsion as well as the hydration capacity of the other detergent components. For example, prior to solidification, preferred liquid detergent emulsions will comprise about 45 to 75% solids, most preferably about 55 to 70% solids and about 25 to 55%, most preferably about 30-45% water. The majority of the solid detergent components will commonly comprise a mixture of a sodium condensed phosphate hardness sequestering agent, e.g., sodium tripolyphosphate, and an inorganic source of alkalinity, preferably an alkali metal hydroxide or silicate. These components will commonly be present in a ratio of phosphate to hydroxide of about 3-4:1. When emulsions of this composition are heated to about 35°-60° C., it is not believed that the phosphate and/or alkali metal hydroxide components would form amounts of molten hydrates effective to significantly contribute to the uniform solidification of the emulsions. Therefore, the alkali metal hydroxide and phosphate are not considered "solidifying agents" within the scope of this invention.

In liquid detergent emulsions which comprise sodium or potassium hydroxide as the primary source of alkalinity, it has been found highly preferable to employ about 0.5-3.0% of a natural or synthetic hectorite clay as a dispersing agent. Although the precise hydration capacities of the clay and the tripolyphosphate under the emulsion formation conditions employed are not known, it has been found in such systems that the addition of about 5-35% by weight of anhydrous sodium carbonate, sodium sulfate or mixtures thereof will effectively solidify these emulsions. Preferably about 10-30% of the solidifying agent will be employed. Of the two preferred solidifying agents, sodium carbonate is preferred since it imparts additional alkalinity to the compositions, and it can be added in any commercially-available form of the anhydrous material, e.g., as light or dense ash.

In the present compositions, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is the most preferred hardness sequestering agent for reasons of its ease of availability, low cost, and high cleaning power. Sodium tripolyphosphate acts to sequester calcium and/or magnesium cations, providing water softening properties. It contributes to the removal of soil from hard surfaces and keeps soil in suspension. It has little corrosive action on washing machines or industrial equipment, and is low in cost compared to other water conditioners. Sodium tripolyphosphate has relatively low solubility in water (about 14 wt-%) and its concentration must be increased using means other than solubility. We believe that there is an interaction between condensed phosphate water conditioning agents, alkali metal hydroxides and the hectorite clay suspending-thickening agents used in the invention which results in stable, white, smooth, pumpable emulsions. These emulsions can be hardened to homogeneous solid compositions with solidifying agents which melt and hydrate at lower temperatures than those commonly employed to harden liquid alkaline detergent compositions. It has further been determined that the use of mixtures of powdered sodium tripolyphosphate and light density sodium tripolyphosphate permits substantial control of the final hardness of the solid compositions. For example, the hardness of the product increases as the amount of powdered tripolyphosphate is increased.

The inorganic alkali content of the highly alkaline cleaners of this invention is preferably derived from sodium or potassium hydroxide which can be used in both liquid (about 10 to 60 wt-% aqueous solution) or in solid (powdered or pellet) form. The preferred form is commercially-available sodium hydroxide, which can be obtained in aqueous solution at concentrations of about 50 wt-% and in a variety of solid forms of varying particle size.

For some cleaning applications, it is desirable to replace a part or all of the alkali metal hydroxide with an alkali metal silicate such as anhydrous sodium metasilicate. When incorporated into the emulsions within the preferred temperature ranges, at a concentration of about 20–30% by weight of the emulsion, anhydrous sodium metasilicate acts as an adjunct solidifying agent and also protects metal surfaces against corrosion.

The alkaline cleaning compositions of this invention can also contain a source of available halogen which acts as a bleaching or destaining agent. Agents which yield active chlorine in the form of hypochlorite or $Cl_2$ can be used. Both organic and inorganic sources of available chlorine are useful. Examples of the chlorine source include alkali metal and alkaline earth metal hypochlorite, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5, 5-dimethylhydantoin, N-chlorosulfamide, Chloramine T, Dichloramine T, Chloramine B and Dichloramine B. The preferred class of sources of available chlorine comprise inorganic chlorine sources such as sodium hypochlorite, monobasic calcium hypochlorite, dibasic calcium hypochlorite, monobasic magnesium hypochlorite, dibasic magnesium hypochlorite, and mixtures thereof. The most preferred source of available chlorine comprises sodium hypochlorite, mono and dibasic calcium hypochlorite, for reasons of availability, low cost and highly effective bleaching action. Encapsulated chlorine sources may also be employed to enhance the storage stability of the chlorine source. Sources of active iodine include povidone-iodine and poloxamer-iodine.

We have discovered that a specific clay thickening agent enhances the stability of the available chlorine concentrations in highly alkaline cleaning systems, inhibits phosphate reversion and provides stable precurser emulsions of the highly alkaline cleaners. The preferred class of clay thickening-suspending agents comprise "synthetic" clays. A synthetic clay is a clay made by combining the individual components from relatively pure materials in production equipment to form a physical mixture which interacts to form a clay-like substance. Non-synthetic or natural clays are minerals which can be derived from the earth's surface. A preferred inorganic synthetic clay combines silicon dioxide, magnesium dioxide, and alkali metal oxides wherein the ratio of silicon dioxide:magnesium oxide is about 1:1 to 1:10 and the ratio of silicon dioxide to alkali metal oxides is about 1:0.5 to 1:0.001. The alkali metal oxides can comprise lithium oxide ($Li_2O$), sodium oxide ($Na_2O$), potassium oxide ($K_2O$), etc. and mixtures thereof. The most preferred clay thickening-suspending agent comprises hectorite-like inorganic synthetic clays which are available from Laporte, Inc., Hackensack, N.J. under the designation Laponite ® and Laponite ® RDS. These clays comprise silicon dioxide, magnesium oxide, sodium oxide, lithium oxide, and structural water of hydration wherein the ratios of $SiO_2$:MgO:$Na_2O$:-$Li_2O$:$H_2O$ are about 25–75:20–40:1–10:0.1–1:1–10. These clays appear to be white, finely divided solids having a specific gravity of about 2–3, an apparent bulk density of about 1 gram per milliliter at 8% moisture, and an absorbence (optical density) of a 1% dispersion in water of about 0.25 units.

When the present solid detergent compositions are designed for use as laundry detergents they will preferably be formulated to contain effective amounts of synthetic organic surfactants and/or fabric softeners. The surfactants and softeners must be selected so as to be stable and chemically-compatible in the presence of alkaline builder salts. One class of preferred surfactants is the anionic synthetic detergents. This class of synthetic detergents can be broadly described as the water-soluble salts, particularly the alkali metal (sodium, potassium, etc.) salts, or organic sulfuric reaction products having in the molecular structure an alkyl radical containing from about eight to about 22 carbon atoms and a radical selected from the group consisting of sulfonic acid and sulfuric acid ester radicals.

Preferred anionic organic surfactants include alkali metal (sodium, potassium, lithium) alkyl benzene sulfonates, alkali metal alkyl sulfates, and mixtures thereof, wherein the alkyl group is of straight or branched chain configuration and contains about nine to about 18 carbon atoms. Specific compounds preferred from the standpoints of superior performance characteristics and ready availability include the following: sodium decyl benzene sulfonate, sodium dodecyl benzene sulfonate, sodium tridecyl benzene sulfonate, sodium tetradecyl benzene sulfonate, sodium hexadecyl benzene sulfonate, sodium octadecyl sulfate, sodium hexadecyl sulfate and sodium tetradecyl sulfate.

Nonionic synthetic surfactants may also be employed, either alone or in combination with anionic types. This class of synthetic detergents may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water soluble or dispersable compound having the desired degree of balance between hydrophilic and hydrophobic elements.

For example, a well-known class of nonionic synthetic detergents is made available on the market under the trade name of "Pluronic." These compounds are formed by condensing ethylene oxide with a hydrophobic base formed by the condensation of propylene oxide with propylene glycol. The hydrophobic portion of the molecule has a molecular weight of from about 1,500 to 1,800. The addition of polyoxyethylene radicals to this hydrophobic portion tends to increase the water solubility of the molecule as a whole and the liquid character of the products is retained up to the point where the polyoxyethylene content is about 50 percent of the total weight of the condensation product.

Other suitable nonionic synthetic detergents include the polyethylene oxide condensates of alkyl phenols, the products derived from the condensation of ethylene oxide with the reaction product of propylene oxide and ethylene diamine, the condensation product of aliphatic fatty alcohols with ethylene oxide as well as amine oxides and phosphine oxides.

Cationic softeners useful herein are commercially-available materials and are of the high-softening type. Included are the imidazolinium softeners, phosphinates and the N,N-di(higher)-$C_{12}$–$C_{24}$, N,N-di(lower)-$C_1$–$C_4$ alkyl quaternary ammonium salts with water solubilizing anions such as halide, e.g., chloride, bromide and iodide; sulfate, methosulfate and the like and the heterocyclic imides such as imidazolinium salts.

For convenience, the aliphatic quaternary ammonium salts may be structurally defined as follows:

$$(R)(R_1)(R_2)(R_3)N^+X^-$$

wherein R and $R_1$ represent alkyl of 12 to 24 and preferably 14 to 22 carbon atoms; $R_2$ and $R_3$ represent lower alkyl of 1 to 4 and preferably 1 to 3 carbon atoms, and X represents an anion capable of imparting water solubility or dispersibility including the aforementioned chloride, bromide, iodide, sulfate and methosulfate. Particularly preferred species of aliphatic quats include: distearyl dimethylammonium chloride, di-hydrogenated tallow dimethyl ammonium chloride, ditallow dimethyl ammonium chloride, distearyl dimethyl ammonium methyl sulfate, and di-hydrogenated tallow dimethyl ammonium methyl sulfate.

Prior to solidification, the cleaning compositions are suspended in water. Soft or deionized water is preferred for reasons that inorganic ($Ca^{++}$ or $Mg^{++}$) cations in service or tap water can combine with and reduce the efficiency of the hardness sequestering agents and can interfere in the formation of a stable emulsion.

The hardness sequestering agent can be present in the emulsion in an effective hardness sequestering amount which comprises about 10 to about 40 wt-% based on the total composition. Preferably the hardness sequestering sodium condensed phosphate can be present in an amount of about 20 to 35 wt-%.

Caustic builders are commonly added to the emulsion cleaner in amounts of about 5 to 25 wt-%. Sodium hydroxide can be added to the emulsion cleaner in solid powders or pellets or in the form of commercially available 50 wt-% caustic concentrates. Preferably the caustic is present in the emulsion in concentrations of about 5 to 15 wt-% (dry basis).

The concentration of the chlorine source in warewashing compositions must be sufficient to provide destaining of dishes in order to remove objectionable tea, coffee, and other generally organic stain materials from the dish surfaces. Commonly in the alkaline cleaners, the concentration of the chlorine yielding substance is about 0.5 to about 10 wt-% of the total composition. The preferred concentration of the alkali metal hypochlorite comprises about 1.0 to about 5.0 wt-%.

An inorganic magnesium oxide-silicon dioxide clay thickening-suspending agent is commonly present in the emulsion cleaner at a sufficient concentration to result in the smooth, stable suspension or emulsion of the alkaline cleaning composition. An effective amount of the clay comprises from about 0.05 to about 5 wt-% of the composition. Preferably, the suspending-thickening clay is present at a concentration of about 0.1 to about 2 wt-% of the highly alkaline emulsion cleaning composition.

The amount of synthetic surfactants and fabric softeners which may be added to the present compositions will vary widely depending on the intended end use of the composition. For example, effective laundry detergents may be prepared comprising about 1–15% of these adjuvants.

The highly alkaline cleaning composition of this invention can be made by combining the components in suitable mixing or agitating equipment which are lined or protected from the highly caustic and bleaching nature of the ingredients and agitating the components until a smooth, stable emulsion is formed which is then permitted to cool and harden. A preferred method for forming the stable emulsions of the invention comprises first forming a stable suspension of the clay thickening-suspending agent in about 20–50% of the total water, and then adding the additional components slowly until a stable emulsion is formed. One precaution involves the addition of caustic which must be added slowly to avoid destabilizing or shocking the clay suspension.

The heat generated by the addition of the sodium or potassium hydroxide solutions can be controlled by adjusting the addition rate, or by the use of external cooling, to raise and maintain the internal temperature of the liquid phase to within the desired range. The addition of the other detergent components can then be controlled so as to maintain the desired temperature until emulsion formation has been completed and it is desired to cool and solidify the emulsion. For example, the further exotherm resulting from the tripolyphosphate addition can be offset by the endotherm resulting from the addition of the anhydrous sodium carbonate. If necessary the emulsion may be allowed to cool slightly, e.g. to about 30°–38° C., prior to the addition of thermally unstable compounds such as surfactants and the chlorine source in order to preserve their activity.

Therefore, prior to solidification the present detergent compositions are liquid, high solids emulsions which preferably comprise about 25 to 45% water, about 0.1–2.5% of the clay thickening agent, about 5 to 15% of an alkali metal hydroxide, about 20–40% of sodium tripolyphosphate, and about 10 to 30% of a solidifying salt such as sodium carbonate, sodium sulfate or mixtures thereof, which solidifying salt has been added to the emulsion in its anhydrous form. Additional components such as about 1–5% of an inorganic chlorine source, added surfactants, softeners, dyes, fillers and the like may also be added. Since the mixing times and temperatures employed to combine these ingredients does not result in substantial moisture loss, the final solid detergent compositions will exhibit substantially the same weight percentages of ingredients as is exhibited by the liquid precurser. Of course, in the solid compositions substantially all of the water is present as water of hydration rather than as free water.

The slurry may then be poured into suitable molds in order to form solid cakes or tablets, which may further be reduced to granules, flakes or powder by conventional grinding and screening procedures.

The solid detergent compositions are stable under storage at ambient conditions, being resistant to eruption, billowing or deliquescence, and rapidly disperse in cold or warm water when introduced into standard washing equipment. The concentration of the components of the highly alkaline emulsion cleaner in the wash water necessary to obtain a destaining effect comprises about 250 to 1,000 parts of sodium tripolyphosphate per million parts of wash water, about 100 to 1,000 parts of sodium hydroxide per million parts of wash water, and about 25 to 100 parts of active chlorine per million parts of wash water. Depending on the concentration of the active ingredients, the cleaner can be added to wash water at a total concentration of all components of about 0.05 to 12 wt-% of the wash water. Preferably, about 1.0 to about 2.0 wt-% of the cleaner can be added to the wash water to obtain acceptable results. Most preferably the cleaner of the invention can be added to wash water at about 0.1 to about 0.5 wt-% to attain high destaining and desoiling activity at low cost.

For warewashing, the compositions of the invention are added to wash water at a temperature of from about 49° C. to about 93° C. and preferably are used in wash water having a temperature of 60° C. to 77° C. The compositions are thereby applied in the wash water to the surfaces of articles to be cleaned. Although any technique common in the use of available ware washing equipment can be used, the cleaning compositions of this invention are specifically designed for and are highly effective in cleaning highly soiled and stained cooking and eating utensils. High effective cleaning with low foaming is obtained in institutional ware washing machines. After contact with the cleaning solutions prepared from the compositions of this invention, the ware is commonly rinsed with water and dried, generally to an unspotted finish. In the use of the highly alkaline cleaners of this invention, food residues are effectively removed and the cleaned dishes and glassware exhibit less spotting and greater clarity than is found in many conventional cleaning compositions, both of a solid and liquid nature.

The invention is further illustrated by the following specific Examples, which should not be used to limit the scope of the invention. All parts or percentages are by weight unless otherwise specifically indicated.

Example I—Carbonate-Sulfate Formulation

A lightning mixer was charged with 980 ml of water and stirring commenced. Laponite RDS (72.48 g) was added in small portions, followed by 1450 g of 50% aqueous sodium hydroxide. The caustic solution was added at a rate so that the temperature of the stirred solution is 49° C. at the completion of the addition. Anhydrous sodium sulfate (724.8 g) was added and the mixture allowed to cool to 40.5° C. Aqueous 5% sodium hypochlorite (1450 g) was added, followed by the addition of 130.6 g of low density sodium tripolyphosphate, 689.6 g of anhydrous low density sodium carbonate, and 579 g anhydrous sodium sulfate, maintaining the temperature of the emulsion at 38°–40.5° C. Stirring was discontinued, and the white slurry poured into two, 8 lb. (3624 g) molds and allowed to cool and harden for 24 hours.

The resultant white solid exhibited a total available chlorine content of 1.57% (sodium thiosulfate titration) which decreased by 9% after one week and by 22.1% after 19 days at ambient conditions. After five days a 0.2% solution was determined to contain 36.7 ppm of free chlorine and 37.9 ppm available chlorine (ferrous ammonium sulfate titration with N,N-diethyl-p-phenylenediamine indicator).

Table I summarizes the results of a glass spot and film test employing the composition of Ex. I.

TABLE I

High Temperature 5-cycle Libbey Glass Spot and Film Evaluation, City Water (5 gr) at 0.2% Dtg. Conc. with 1% Beef Stew Soil

| | Tomato Juice Rating | Milk Rating | Redeposition Rating |
|---|---|---|---|
| 2 Cycles | | | |
| spot | 1.5 | 2.0 | 1.5 |
| film | 1.5 | 2.0 | 2.5 |
| 4 Cycles | | | |
| spot | 1.5 | 2.0 | 1.5 |
| film | 1.5 | 2.5 | 3.0 |
| 5 Cycles | | | |
| spot | 1.5 | 2.0 | 1.5 |

TABLE I-continued

High Temperature 5-cycle Libbey Glass Spot and Film Evaluation, City Water (5 gr) at 0.2% Dtg. Conc. with 1% Beef Stew Soil

| | Tomato Juice Rating | Milk Rating | Redeposition Rating |
|---|---|---|---|
| film | 2.5 | 2.5 | 3.0 |

Ratings: 1 = Clean; 2 = Slight; 3 = Moderate

Example II—Sodium Carbonate Formulation

The procedure of Ex. I was followed, eliminating the sodium sulfate. The first sodium sulfate addition was replaced with 978 g of anhydrous sodium carbonate, the sodium tripolyphosphate content was increased from 18% to 24% (1741 g), and the second anhydrous sodium carbonate addition was increased to 609 g (23.5% total low density ash).

Table II summarizes the improved spot and film test results achieved with tablets of this product.

TABLE II

High Temperature 6-Cycle Libbey Glass Spot and Film Evaluation, City Water (5.0 gr) at 0.2% Dtg. Conc. with 1% Beef Stew Soil

| | Tomato Juice Rating | Milk Rating | Redeposition Rating |
|---|---|---|---|
| 2 Cycles | | | |
| spot | 1.0 | 1.0 | 1.0 |
| film | 1.5 | 1.5 | 1.5 |
| 4 Cycles | | | |
| spot | 1.0 | 1.0 | 1.0 |
| film | 1.5 | 1.5 | 2.0 |
| 6 Cycles | | | |
| spot | 1.0 | 1.0 | 1.0 |
| film | 1.5 | 1.5 | 1.5 |

Example III—High Phosphate Formulation

A stainless steel mixing vessel equipped with a water cooling jacket and variable speed turbine stirring was charged with 2.94 l of soft water and stirring begun. Laponite RDS (108 g) was slowly sprinkled into the water and the mixture stirred for 20–30 min until the Laponite was totally dispersed. Aqueous 50% sodium hydroxide (4349 g) was slowly added and cold water circulated through the jacket to limit the internal temperature to 49° C. To the stirred solution was added 1200 g of low density anhydrous sodium carbonate and 2829 g of anhydrous sodium tripolyphosphate, while maintaining the temperature of the stirred slurry at 40°–46° C. The slurry was stirred an additional 10 min and 4349 g of 5% aqueous sodium hypochlorite (at least 7.5% available chlorine) added, followed by addition of 4569 g of low density sodium tripolyphosphate and 1415 g of anhydrous low density sodium carbonate. The mixture was stirred an additional 0.5 hr at 38°–43° C. and then employed to fill six, 8 lb. capsules and allowed to harden under ambient conditions to yield a white solid (1.57% available chlorine). The available chlorine was about 70% retained after one month of storage under ambient conditions, and about 50% retained after two months.

EXAMPLE IV

The procedure of Example III is employed to prepare and solidify detergent emulsions containing the ingredients listed in Table III, below. Except as noted, the ingredients are mixed in the order indicated and allowed to harden for at least 6.0 hrs under ambient conditions.

TABLE III

| Ingredient | Detergent Formulations Weight Percent A | B | C | D | E |
|---|---|---|---|---|---|
| Soft Water | 14.0 | 11.0 | 14.0 | 20.0 | 15.0 |
| Laponite RDS | 0.5 | 1.0 | 1.0 | 1.0 | 1.0 |
| 50% aq. sodium hydroxide | 19.0 | 20.0 | 15.0 | — | 20.0 |
| Anhydrous sodium carbonate | 8.0* | — | 4.0 | 9.0 | — |
| Anhydrous sodium tripolyphosphate | 8.5 | 9.0 | 6.0 | 21.0 | 10.0 |
| 5% aq. sodium hypochlorite | 20.0 | ++ | 12.0 | 20.0 | ++ |
| Anhydrous sodium tripolyphosphate | 13.0** | 22.0 | 17.0 | — | 15.0 |
| Anhydrous sodium carbonate | 17.0* | 10.0 | 19.0 | 9.0 | 20.0 |
| Anhydrous sodium metasilicate | — | — | — | 20.0+ | — |
| Organic detergent | — | — | 12.0# | — | 5.0# |

*Light density soda ash.
**Light density TPP.
+Replaces sodium hydroxide in A.
++Replace 20% hypochlorite with 20% soft water (B) or 15% soft water (E).
#Add with hypochlorite solution (C) or with second batch of water (E); Sodium $C_{14}$–$C_{17}$ Alkyl Sec Sulfonate.

The solid formulations of Exs. III, IVA–B and D are designed to function as high-performing, low temperature warewashing detergents. The high phosphate levels in the formulations of Exs. III, IVA and IVB should render them highly effective against protein and chloroprotein soils. The formulation of Ex. IV-D, in which anhydrous sodium metasilicate replaces the sodium hydroxide, is designed as a metal-protecting, destaining warewashing detergent.

The formulation of Ex. IVC is designed as a high performance laundry product. The sodium hydroxide could be partially or totally replaced by anhydrous sodium metasilicate. Other chlorine-stable anionic and/or nonionic surfactants could be employed in place of the indicated sodium s-alkyl sulfonate.

The formulation of Ex. IVE is designed as a heavy-duty grease-removing composition which is expected to be effective for hard-surface cleaning, especially in institutional settings.

The invention has been described with reference to various specific and preferred embodiments and techniques. However, it should be understood that many variations and modifications may be made while remaining within the spirit and scope of the invention.

What is claimed is:

1. A detergent composition comprising:

(a) about 5–25% of an alkali metal hydroxide;

(b) a condensed phosphate hardness sequestering agent; and (c) an amount of a solidifying agent selected from the group consisting of hydrated sodium carbonate, hydrated sodium sulfate and mixtures thereof, which is effective to harden the detergent composition into a uniform solid.

2. The detergent composition of claim 1 wherein the composition has been hardened in a mold.

3. The detergent composition of claim 1 wherein the solidifying agent is selected from the group consisting of sodium carbonate decahydrate, sodium sulfate decahydrate or mixtures thereof.

4. The detergent composition of claim 1 wherein the solidifying agent comprises hydrated sodium metasilicate.

5. The detergent composition of claim 1 wherein the condensed phosphate hardness sequestering agent comprises an alkali metal tripolyphosphate.

6. The detergent composition of claim 5 wherein the weight ratio of the alkali metal tripolyphosphate to the alkali metal tripolyphosphate to the alkali metal hydroxide is about 3–4:1.

7. The detergent composition of claim 1 which comprises a synthetic clay suspending agent.

8. The detergent composition of claim 1 which comprises a source of active halogen.

9. The detergent composition of claim 1 which comprises an effective amount of a synthetic organic surfactant.

10. The detergent composition of claim 2 which comprises about 25–45% water of hydration.

* * * * *